US008035061B2

(12) United States Patent
Jung

(10) Patent No.: US 8,035,061 B2
(45) Date of Patent: Oct. 11, 2011

(54) HAIRDRESSING DEVICE

(75) Inventor: Jung Shim Jung, Seoul (KR)

(73) Assignee: Blueceramic Co., Ltd., Incheon-Si (KR)

( * ) Notice: Subject to any disclaimer, the term of this patent is extended or adjusted under 35 U.S.C. 154(b) by 590 days.

(21) Appl. No.: 12/147,386

(22) Filed: Jun. 26, 2008

(65) Prior Publication Data

US 2009/0260650 A1 Oct. 22, 2009

(30) Foreign Application Priority Data

Apr. 17, 2008 (KR) ..... 10-2008-0035730

(51) Int. Cl.

| | |
|---|---|
| ***H05B 3/22*** | (2006.01) |
| ***A45D 1/04*** | (2006.01) |
| ***A45D 1/06*** | (2006.01) |
| ***A45D 1/28*** | (2006.01) |
| ***A45D 7/00*** | (2006.01) |

(52) U.S. Cl. ..... 219/225; 132/223; 132/269

(58) Field of Classification Search ..... None
See application file for complete search history.

(56) References Cited

U.S. PATENT DOCUMENTS

| | | | | |
|---|---|---|---|---|
| 5,725,600 | A * | 3/1998 | Caisey et al. | 8/103 |
| 2004/0237990 | A1 | 12/2004 | Choi | |
| 2009/0107518 | A1 * | 4/2009 | Cohen | 132/224 |
| 2009/0165811 | A1 * | 7/2009 | Zimmerman | 132/203 |

FOREIGN PATENT DOCUMENTS

| | | | |
|---|---|---|---|
| JP | 2000157322 | A * | 6/2000 |
| KR | 1020060001812 | A | 1/2006 |
| WO | WO 2007094550 | A1 * | 8/2007 |

* cited by examiner

*Primary Examiner* — Joseph M Pelham
(74) *Attorney, Agent, or Firm* — Ladas & Parry LLP

(57) ABSTRACT

A hairdressing device is designed to heat a hair at different temperatures. The device includes first and second arms coupled together by a hinge so that the arms can be closed together when pressed toward each other, each of the first and second arms including a grip portion and a head portion extending from the grip portion. The first arm includes a first heat generating body having at least one electric heater arranged in the head portion for heating a hair. The second arm includes a second heat generating body having two electric heaters arranged side by side in the head portion for heating the hair at different temperatures and a digital display part provided on an outer surface of the second arm for indicating information on a permanent to be performed.

2 Claims, 4 Drawing Sheets

HAIRDRESSING DEVICE

FIELD OF THE INVENTION

The present invention relates to a hairdressing device and, more particularly, to hairdressing device capable of restoring a damaged hair by use of laser beams and infrared rays, capable of indicating a point of time for straight permanent by voice or through a digital display part and capable of performing the straight permanent at a high temperature and a low temperature.

BACKGROUND OF THE INVENTION

Typically, a hairdressing device is used to produce various kinds of hair styles. There are many different kinds of hairdressing devices, including a hair drier for getting a hair dried, a hair curler for waving a hair and a device for straightening a hair. Most of these hairdressing devices are operated by electric power.

The present invention is directed to a hairdressing device for straightening a hair, i.e., for applying a straight permanent to the hair. One example of such hairdressing device is illustrated in FIG. 1.

Referring to FIG. 1, a conventional hairdressing device for applying a straight permanent to a hair is formed of first and second arms 10-1 and 10-2, both of which include a pair of grip portions 4-1 and 4-2, a pair of head portions 8-1 and 8-2 extending from the grip portions 4-1 and 4-2 and a pair of heat generating bodies 6-1 and 6-2 attached to the inner surfaces of the head portions 8-1 and 8-2.

The first and second arms 10-1 and 10-2 are coupled together at their one ends by means of a hinge 12 so that they can be rotated about a hinged point when an external force is applied to the grip portions 4-1 and 4-2.

The heat generating bodies 6-1 and 6-2 are of a planar shape and are heated by electric power. Upon pressing the grip portions 4-1 and 4-2 together, the heat generating bodies 6-1 and 6-2 come into contact with each other. The hair is straightened if the hairdressing device is pulled along the hair nipped between the heat generating bodies 6-1 and 6-2.

The hairdressing device noted above may be used in performing a straight permanent by which a hair such as a curly hair or the like is straightened. When performing the straight permanent, a liquid permanent solution is first applied to the hair to neutralize the same. If the hair is neutralized and if it is the time to perform a straight permanent, the heat generating bodies 6-1 and 6-2 are heated up to a specified temperature by supplying an electric current to the hairdressing device.

Once the heat generating bodies 6-1 and 6-2 reach the specified temperature, a user holds the grip portions 4-1 and 4-2 of the hairdressing device with one hand and pulls the hair away from the head with the other hand. Then, the hair is positioned between the heat generating bodies 6-1 and 6-2 of the head portions 8-1 and 8-2 which are kept spread apart.

Subsequently, the hairdressing device is moved along the hair while pressing the grip portions 4-1 and 4-2 together. As a result, the hair is ironed out into a straight shape by the heat generating bodies 6-1, thereby terminating a straight permanent.

After the straight permanent has been completed, a curing agent is applied to the hair to prolong the duration of the straight permanent. Unlike a typical wave permanent, the straight permanent endures for about six months.

In the straight permanent performed as above, it is important to accurately determine the degree of neutralization of the hair prior to performing the straight permanent. This is because the hair may suffer from severe damage if the permanent is performed in an improperly neutralized state.

In case a straight permanent is performed by a conventional hairdressing device, the degree of neutralization of a hair is empirically determined by pulling the hair after a specified period of time has lapsed from the time of application of a liquid permanent solution. This means that a beginner may encounter a difficulty in accurately determining the point of time for performing the permanent, which is problematic in that the hair may be severely damaged by inaccurate determination of the point of time for performing the permanent. Particularly, in case of an artificial hair, there is a problem in that the permanent effect may easily disappear if the degree of neutralization is improper.

SUMMARY OF THE INVENTION

In view of the problems inherent in the prior art, it is an object of the present invention to provide a hairdressing device capable of restoring a damaged hair by use of laser beams and infrared rays.

Another object of the present invention is to provide a hairdressing device that makes it possible to easily learn the degree of neutralization of a hair when performing a straight permanent.

A further object of the present invention is to provide a hairdressing device capable of indicating a proper point of time for straight permanent by voice or digitally.

A still further object of the present invention is to provide a hairdressing device capable of performing a permanent at either of a high temperature and a low temperature and therefore capable of easily performing a permanent for an artificial hair as well as a natural hair.

With the above objects in view, the present invention provides a hairdressing device comprising first and second arms coupled together by a hinge so that the arms can be closed together when pressed toward each other, each of the first and second arms including a grip portion and a head portion extending from the grip portion, wherein the first arm includes a first heat generating body having at least one electric heater arranged in the head portion for heating a hair, and wherein the second arm includes a second heat generating body having two electric heaters arranged side by side in the head portion for heating the hair at different temperatures and a digital display part provided on an outer surface of the second arm for indicating information on a permanent to be performed.

With the hairdressing device noted above, the electric heater of the first heat generating body of the first arm includes first and second ceramic heaters arranged in a parallel relationship with each other, and the first arm has a plurality of vapor suction holes formed at a generally equal interval between the first and second ceramic heaters.

With the hairdressing device noted above, the two ceramic heaters of the second heat generating body of the second arm include third and fourth ceramic heaters arranged in a parallel relationship with each other, and the second arm has a diode unit provided between the third and fourth ceramic heaters.

With the hairdressing device noted above, the diode unit includes a plurality of laser diodes for irradiating laser beams on the hair and a plurality of infrared diodes for emitting infrared rays toward the hair, the laser diodes and the infrared diodes arranged alternately along the third and fourth ceramic heaters.

With the hairdressing device noted above, the first and third ceramic heaters are designed to heat the hair in a temperature range of 200° C. to 250° C., and the second and fourth ceramic heaters are designed to heat the hair in a temperature range of 55° C. to 75° C.

With the hairdressing device noted above, the electric heater of the first heat generating body of the first arm includes a single ceramic heater, and an ion generator is provided on an inner surface of the first arm for generating negative ions.

In accordance with the present invention, there is provided an advantageous effect in that it is possible to accurately determine the point of time for straight permanent by transmitting laser beams through a hair.

Another advantageous effect provided by the present hairdressing device resides in that it is possible to easily perform a permanent for an artificial hair as well as a natural hair by selectively using a high temperature heat generating body and a low temperature heat generating body.

A further advantageous effect provided by the present hairdressing device lies in that it is possible to restore a damaged hair and to make the hair glossy and soft by irradiating negative ions or infrared rays on the hair when performing a permanent.

BRIEF DESCRIPTION OF THE DRAWINGS

The above and other objects and features of the present invention will become apparent from the following description of preferred embodiments, given in conjunction with the accompanying drawings, in which.

DETAILED DESCRIPTION OF THE PREFERRED EMBODIMENTS

Figure 1:
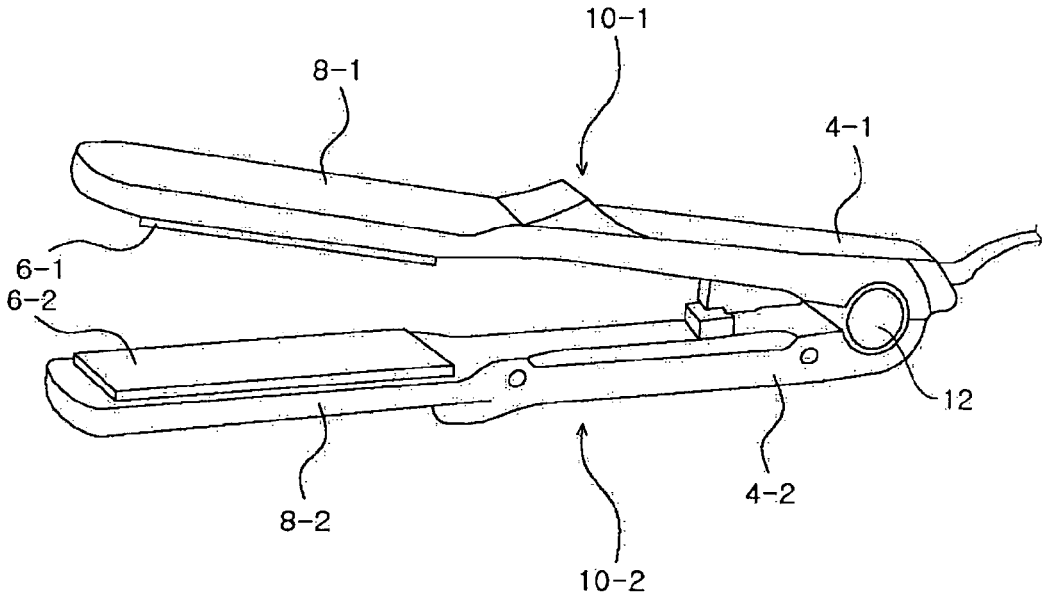
Figure 1 (Prior Art)
FIG. 1 is a perspective view illustrating a conventional hairdressing device.

Preferred embodiments of a hairdressing device in accordance with the present invention will now be described in detail with reference to the accompanying drawings. The same reference numerals as used in describing the prior art will be used to designate the same elements as those of the prior art.

Figure 2:
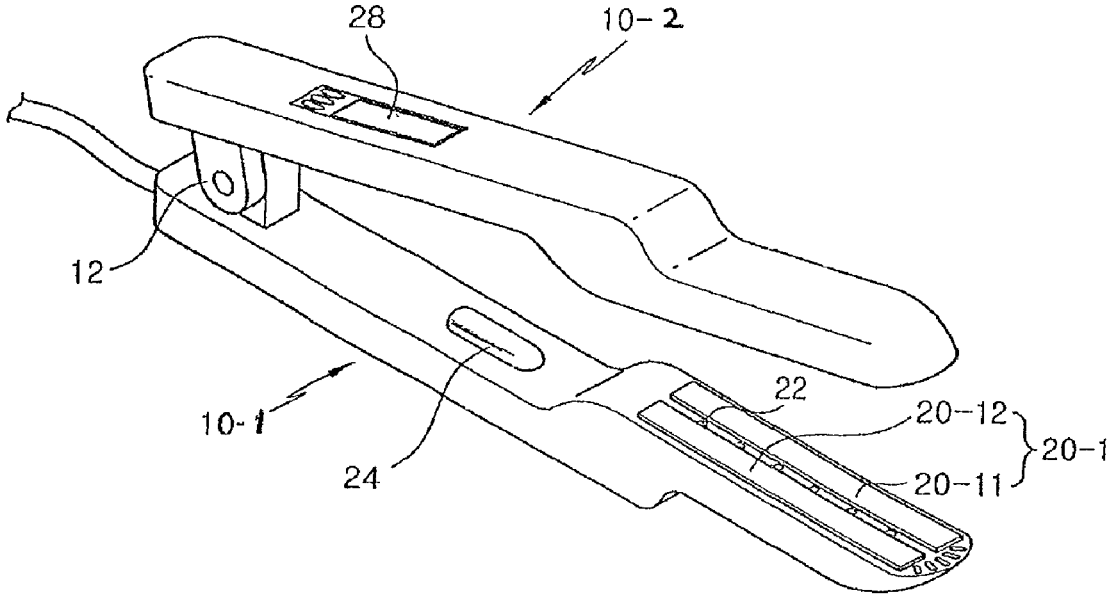
FIG. 2 is a perspective view showing a hairdressing device in accordance with one embodiment of the present invention.
Figure 3:
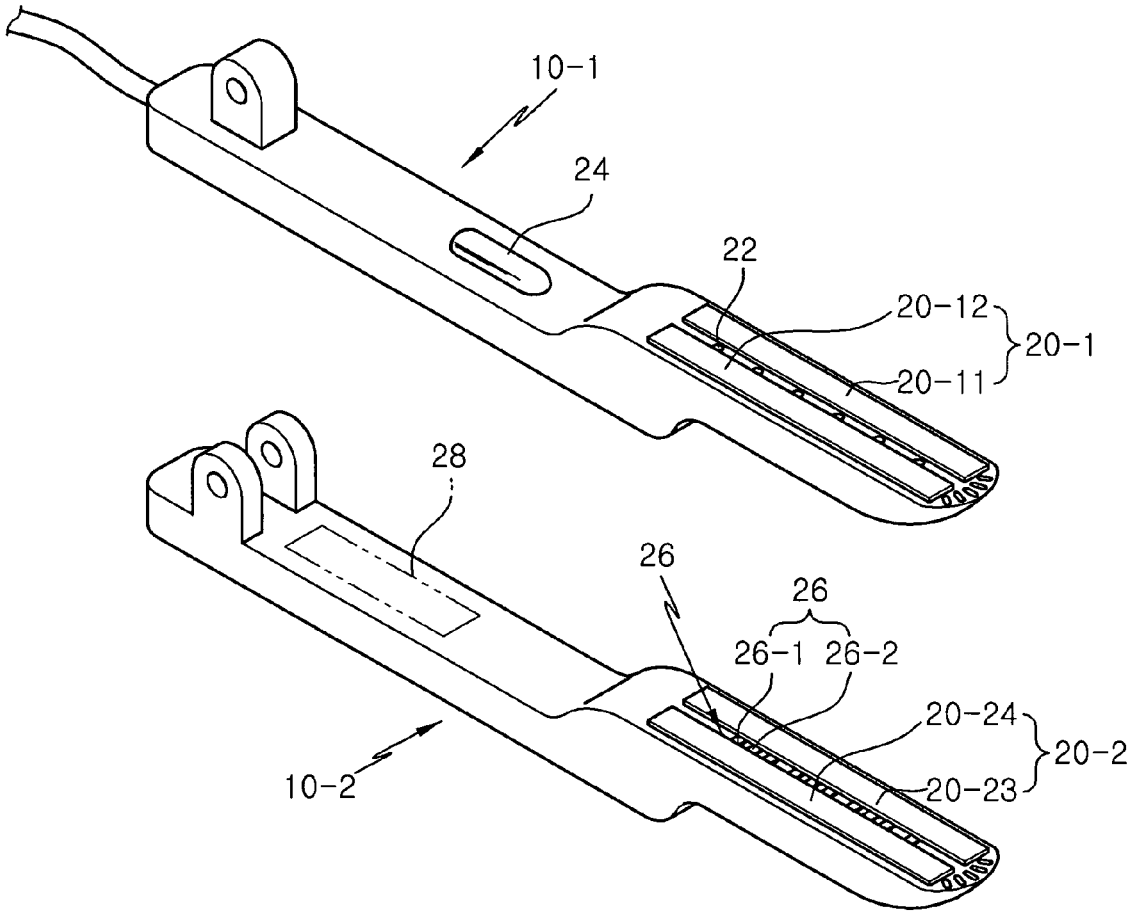
FIG. 3 is an exploded perspective view of the hairdressing device shown in FIG. 2.

Referring to FIG. 2, a hairdressing device of the present invention includes first and second arms 10-1 and 10-2 that can rotate about a hinge 12 at a specified angle. The first and second arms 10-1 and 10-2 can be closed together when pressed toward each other. Each of the first and second arms is formed of a grip portion and a head portion extending from the grip portion. The first arm 10-1 includes first heat generating body 20-1 having two electric heaters, e.g., first and second elongated ceramic heaters 20-11 and 20-12, arranged side by side in the head portion of the first arm 10-1 for heating a hair at different temperatures. The first heat generating body 20-1 has a plurality of vapor suction holes 22 arranged at an equal interval between the first and second ceramic heaters 20-11 and 20-12. The vapor suction holes 22 serve to suck up the vapor generated when performing a permanent for a wet hair.

The first and second ceramic heaters 20-11 and 20-12 are coated with titanium or palladium by an anodizing method so that they can reflect laser beams. The first and second ceramic heaters 20-11 and 20-12 are arranged in a parallel relationship with each other and are designed to generate heat at different temperatures. The first ceramic heater 20-11 is spaced apart from the second ceramic heater 20-12 so that the vapor suction holes 22 can be arranged therebetween. The first ceramic heater 20-11 is designed to generate heat whose temperature is higher than that of the heat generated by the second ceramic heater 20-12. In contrast, the second ceramic heater 20-12 is designed to generate heat whose temperature is lower than that of the heat generated by the first ceramic heater 20-11.

The reason for differently setting the heating temperature of the first and second ceramic heaters 20-11 and 20-12 is that a permanent can be easily performed if a hair is first heated at a high temperature and then at a low temperature.

An ion generator 24 for generating negative ions is arranged on the inner surface of the first arm 10-1. The ion generator 24 is designed to electrically generate negative ions during the course of performing a straight permanent. The negative ions emitted from the ion generator 24 helps prevent the hair from being damaged by the permanent.

The second arm 10-2 is hingedly coupled to the first arm 10-1 and includes a second heat generating body 20-2 arranged in a confronting relationship with the first heat generating body 20-1. The second heat generating body 20-2 includes two electric heaters, e.g., third and fourth elongated ceramic heaters 20-23 and 20-24, arranged side by side in the head portion of the second arm 10-2 for heating the hair at different temperatures. A diode unit 26 for irradiating laser beams and infrared rays is arranged between the third and fourth ceramic heaters 20-23 and 20-24.

The third and fourth ceramic heaters 20-23 and 20-24 are coated with titanium or palladium by an anodizing method so that they can reflect the laser beams irradiated from the diode unit 26. The third and fourth ceramic heaters 20-23 and 20-24 are arranged in a parallel relationship with each other and are designed to generate heat at different temperatures. The third ceramic heater 20-23 is spaced apart from the fourth ceramic heater 20-24 and is designed to generate heat whose temperature is higher than that of the heat generated by the fourth ceramic heater 20-24. In contrast, the fourth ceramic heater 20-24 is designed to generate heat whose temperature is lower than that of the heat generated by the third ceramic heater 20-23.

The reason for differently setting the heating temperature of the third and fourth ceramic heaters 20-23 and 20-24 is that the permanent can be easily performed if the hair is first heated at a high temperature and then at a low temperature.

Figure 4:
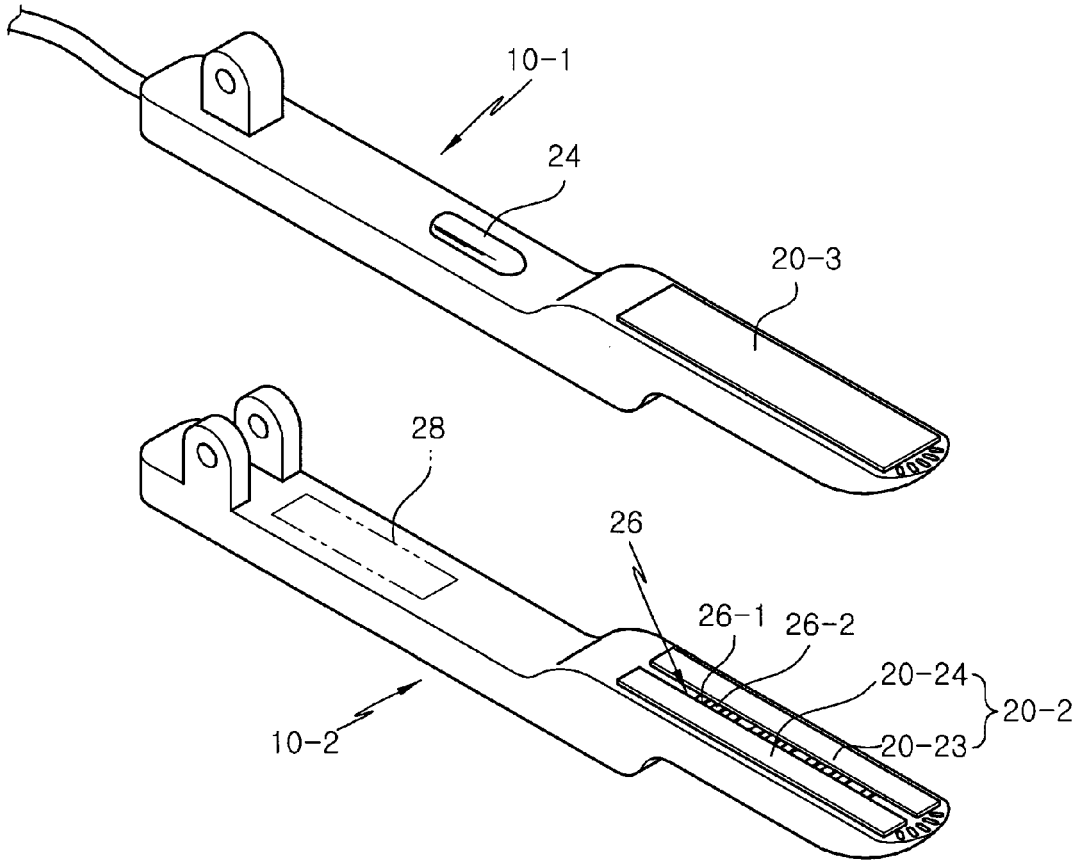
FIG. 4 is an exploded perspective view showing a hairdressing device in accordance with another embodiment of the present invention.

Although the first through fourth ceramic heaters 20-11 to 20-24 are arranged in pair according to the embodiment set forth above, one of the first and second arms 10-1 and 10-2 may include a heat generating body 20-3 having a single electric heater, e.g., a single elongated ceramic heater, as illustrated in FIG. 4.

The diode unit 26 is arranged between the third and fourth ceramic heaters 20-23 and 20-24 of the second heat generating body 20-2. The diode unit 26 includes a plurality of laser diodes 26-1 for irradiating laser beams and a plurality of infrared diodes 26-2 for irradiating infrared rays. It is preferred that the laser diodes 26-1 and the infrared diodes 26-2 be arranged alternately.

The laser diodes 26-1 serve to emit laser beams toward the hair. The laser beams are transmitted through the hair and reflected by the first heat generating body 20-1. A laser sensor (not shown) is provided to sense the laser beams. Depending on the intensity of the laser beams, i.e., the degree of neutralization of the hair detected by the laser sensor, a proper point of time for straight permanent is indicated on a digital display part 28 provided in the second arm 10-2. The digital display part 20 serves to indicate information on the permanent to be performed by the hairdressing device. Alternatively or additionally, the proper point of time for straight permanent may be indicated by a voice message.

The laser beams emitted toward the hair pass through a normal hair without affecting the same. However, when the laser beams pass through a damaged hair, the damaged portions of the hair are melted and restored by the laser beams.

The infrared diodes 26-2 are designed to irradiate infrared rays on the hair during the course of performing the permanent, thereby keeping the hair against damage and maintaining the same healthy.

The digital display part 28 provided in the second arm 10-2 serves to indicate a heating temperature, a laser output, an infrared output, a proper point of time for straight permanent and other information. The proper point of time for straight permanent may be indicated by voice to enhance convenience in use.

The first and second heat generating bodies 20-1 and 20-2, the ion generator 24 and the digital display part 28 of the first and second arms 10-1 and 10-2 are controlled by means of a controller installed in one or both of the first and second arms 10-1 and 10-2.

The first and third ceramic heaters 20-11 and 20-23 are adapted to generate heat at a temperature of 200° C. to 250° C. and preferably 230° C. The second and fourth ceramic heaters 20-12 and 20-24 are adapted to generate heat at a temperature of 55° C. to 75° C. and preferably 65° C.

By differentiating the heating temperatures of the first and second heat generating bodies 20-1 and 20-2 as mentioned above, the hair can be first heated at a high temperature and then at a low temperature. This makes it possible to freely perform a permanent regardless of a natural hair and an artificial hair and also to keep the permanent for an extended period of time.

Functions and operations of the hairdressing device in accordance with the present invention will be described below.

If electric power is applied to the hairdressing device, the user manipulates buttons of the digital display part 28 to set the heating temperatures of the first and second heat generating bodies 20-1 and 20-2, the conditions of generation of negative ions and infrared rays, the vapor suction conditions, and so forth. Then, a liquid permanent solution such as liquid ammonia or the like is applied to the hair in preparation for a straight permanent.

After a specified period of time has lapsed, the digital display part 28 is manipulated to allow the laser diodes 26-1 to emit laser beams. In this state, the hair is nipped between the first and second heat generating bodies 20-1 and 20-2. The laser beams emitted from the laser diodes 26-1 is transmitted through the hair and reflected by the first heat generating body 20-1. The laser beams thus reflected are sensed by the laser sensor. Based on the sensing results, the degree of neutralization of the hair is determined by the controller. If the degree of neutralization reaches a desired value, the digital display part 28 indicates that it is the proper point of time for straight permanent. The proper point of time for straight permanent is notified to the user by a voice message, too. This enables the user to accurately recognize the proper point of time for straight permanent, as compared to a conventional method by which the point of time for straight permanent is empirically determined by pulling the hair.

If the proper point of time for straight permanent comes, the hair coated with a liquid permanent solution is nipped between the first and second heat generating bodies 20-1 and 20-2 and then the hairdressing device is slid down along the hair. As a consequence, the hair is subjected to the straight permanent and is set straight.

During the straight permanent, the ion generator 26 emits negative ions toward the hair and the infrared diodes 26-2 irradiate infrared rays on the hair. Under the influence of the negative ions and the infrared rays, the hair is prevented from damage and is kept glossy and healthy.

On the other hand, the vapor generated during the downward sliding moment of the hairdressing device is sucked up into the vapor suction holes 22 formed between the first ceramic heater 20-11 and the second ceramic heater 20-12 of the first heat generating body 20-1. This enables the user to easily perform the permanent, because the vapor is prevented from hindering the visibility of the user.

With the present hairdressing device, the hair is first ironed or thermally cured at as high a temperature as about 230° C. by means of the first and third ceramic heaters 20-11 and 20-23. Then, the hair is ironed or thermally cured at as low a temperature as about 65° C. by means of the second and fourth ceramic heaters 20-12 and 20-24.

This makes it possible for the present hairdressing device to perm an artificial hair as well as a natural hair according to the user's intention. In general, an artificial hair is more difficult to perm than a natural hair and has a tendency to be soon returned back to a pre-permanent state. With the present hairdressing device, however, it is possible to perm the artificial hair with ease and to prolong the duration of the permanent. This is because the present hairdressing device is operable at a high temperature and/or at a low temperature.

The present hairdressing device can also be used in dying a hair. In order to dye a hair, a hair dye chemical is first applied to the hair, thereby making the hair pliant and soft. Then, the hair is washed with water and coated with a curing agent. Subsequently, the present hairdressing device is slid along the hair in a state that the hair is nipped between the first and second heat generating bodies 20-1 and 20-2. As a result, the hair dye chemical is stuck to the hair and cured in that state.

During the course of dying the hair, it is preferred that the hairdressing device is slid along the hair while irradiating laser beams on the same. At this time, the hair is heated by the first and second heat generating bodies 29-1 and 20-2, and the laser beams is transmitted through the hair. The laser beams pass through a normal hair without affecting the same. However, when the laser beams pass through a damaged hair, the damaged portions of the hair are melted and bonded together. Thus, the damaged hair is restored to a glossy and healthy state. Furthermore, the laser beams irradiated during the course of dying the hair ensures that the hair dye chemical firmly adheres to the surface of the hair. This makes the color of the dyed hair vivid and allows the hair dying work to be performed rapidly.

While certain preferred embodiments of the invention have been described hereinabove, the present invention is not limited to these embodiments. It is to be understood that various changes and modifications may be made without departing from the scope of the invention defined in the claims.

What is claimed is:

1. A hairdressing device comprising first and second arms coupled together by a hinge so that the arms can e closed together when pressed toward each other, each of the first and second arms including a grip portion and a head portion extending from the grip portion, wherein the first arm includes a first heat generating body having at least one electric heater arranged in the head portion for heating air, and wherein the second arm includes a second heat generating body having two electric haters arranged side by side in the head portion for heating the hair at different temperatures and a digital display part provided on an outer surface of the second arm for indicating information on a permanent to be performed, wherein the electric heater of the first heat generating body of the first arm includes first and second ceramic heaters arranged in a parallel relationship with each other and wherein the first arm has a plurality of vapor suction holed forms at a generally equal interval between the first and second ceramic heaters, wherein the two ceramic of the second heat generating body of the second arm include third and fourth ceramic heaters arranged in a parallel relationship with each other and wherein the second arm has a diode unit provided between the third and fourth ceramic heaters; and where the first and third ceramic heaters are designed to heat the hair in a temperature range of 200° C. to 250° C., and the second and fourth ceramic heaters are designed to heat the hair in a temperature range of 55° C. to 75° C.

2. The hairdressing device as recited in claim 1, wherein the diode unit includes a plurality of laser diodes for irradiating laser beams on the hair and a plurality of infrared diodes for emitting infrared rays toward the hair, the laser diodes and the infrared diodes arranged alternately along the third and fourth ceramic heaters.

* * * * *